US011219574B2

(12) United States Patent
Depta

(10) Patent No.: US 11,219,574 B2
(45) Date of Patent: Jan. 11, 2022

(54) EXERCISE AND THERAPY DEVICES

(71) Applicant: Barbara Depta, Palm Beach Gardens, FL (US)

(72) Inventor: Barbara Depta, Palm Beach Gardens, FL (US)

( * ) Notice: Subject to any disclaimer, the term of this patent is extended or adjusted under 35 U.S.C. 154(b) by 182 days.

(21) Appl. No.: 16/509,291

(22) Filed: Jul. 11, 2019

(65) Prior Publication Data

US 2020/0016026 A1 Jan. 16, 2020

Related U.S. Application Data

(60) Provisional application No. 62/814,803, filed on Mar. 6, 2019, provisional application No. 62/697,201, filed on Jul. 12, 2018.

(51) Int. Cl.
*A61H 15/00* (2006.01)

(52) U.S. Cl.
CPC ..... *A61H 15/00* (2013.01); *A61H 2201/1284* (2013.01); *A61H 2201/165* (2013.01); *A61H 2201/1642* (2013.01); *A61H 2201/1695* (2013.01); *A61H 2203/0406* (2013.01); *A61H 2205/12* (2013.01)

(58) Field of Classification Search
CPC ..... A61H 15/00; A61H 2201/1284; A61H 2201/1642; A61H 2205/12; A61H 2201/1695; A61H 2203/0406; A61H 2201/165; A61H 2015/0042; A61H 1/00; A63B 21/02; A63B 21/40; A63B 21/4011–4015; A63B 21/055–0557
See application file for complete search history.

(56) References Cited

U.S. PATENT DOCUMENTS 1,741,340 A * 12/1929 Scholl ..... A43B 7/1445 2/239
3,612,043 A * 10/1971 Inaki ..... A61H 15/00 601/118
3,888,242 A * 6/1975 Harris ..... A61H 9/0078 601/152
4,544,155 A * 10/1985 Wallenbrock ..... A63B 21/04 473/213
4,694,831 A * 9/1987 Seltzer ..... A43B 7/00 15/227
4,774,776 A * 10/1988 Gulli ..... A43B 5/18 36/132
5,113,850 A * 5/1992 Larremore ..... A43B 3/00 601/136
5,554,107 A * 9/1996 Shannahan ..... A61F 13/065 2/16

(Continued)

OTHER PUBLICATIONS

Chicago Balance Paws at HealthyKin.com; https://www.healthykin.com/p-2834-chango-balance-paws.aspx (Last Visited Sep. 17, 2018).

(Continued)

*Primary Examiner* — Andrew S Lo
(74) *Attorney, Agent, or Firm* — Marshall, Gerstein & Borun LLP

(57) ABSTRACT

An example exercise and therapy device includes a foot covering. The foot covering includes a pocket. The exercise and therapy device also includes a pliable object. The pliable object is received within the pocket and arranged to be placed adjacent a foot of an individual wearing the foot covering.

13 Claims, 16 Drawing Sheets

(56) References Cited

U.S. PATENT DOCUMENTS 5,682,690 A * 11/1997 Chang ..... A43B 7/00 36/11.5
5,702,354 A * 12/1997 DeSpain ..... A63B 23/10 482/132
5,736,213 A * 4/1998 Meier ..... A45D 34/04 15/222
5,802,743 A * 9/1998 Chien ..... A43B 7/00 36/11.5
5,897,474 A 4/1999 Romero
6,001,119 A * 12/1999 Hampson ..... A61H 9/0078 601/27
6,007,501 A * 12/1999 Cabados ..... A61H 39/04 601/131
6,322,530 B1 * 11/2001 Johnson, Jr. ..... A61F 5/0111 128/DIG. 20
6,551,225 B1 4/2003 Romero
7,462,158 B2 * 12/2008 Mor ..... A61H 23/0218 482/148
7,517,324 B2 * 4/2009 Cohen ..... A61H 7/001 601/135
8,241,232 B2 * 8/2012 Sanders ..... A61H 1/0266 601/124
8,397,404 B2 * 3/2013 Kim ..... A43B 17/00 36/103
9,370,705 B2 * 6/2016 Grzesiak ..... H02G 3/0475
9,421,117 B1 * 8/2016 Hames ..... A61F 5/0111
9,693,927 B2 * 7/2017 Mor ..... A43B 13/145
9,950,241 B2 * 4/2018 Pfeifer ..... A63C 5/02
10,130,549 B2 * 11/2018 Balducci ..... A43B 7/142
10,758,771 B1 * 9/2020 Cranke ..... A63B 21/00185
10,918,557 B2 * 2/2021 Richardson ..... A61F 13/085
2003/0009118 A1 * 1/2003 Sabo ..... A61H 15/00 601/137
2004/0236261 A1 * 11/2004 McCarthy ..... A61F 5/012 602/65
2004/0249322 A1 * 12/2004 Cohen ..... A61H 7/001 601/131
2007/0073208 A1 * 3/2007 Drennan ..... A61F 13/064 602/36
2007/0191193 A1 * 8/2007 Backes ..... A61H 1/0266 482/79
2009/0024066 A1 * 1/2009 Sorg ..... A43D 999/00 602/27
2009/0149303 A1 * 6/2009 Meisterling ..... A63B 21/4015 482/124
2010/0041527 A1 * 2/2010 Miller ..... A63B 21/4015 482/124
2010/0049111 A1 * 2/2010 Sorg ..... A43B 7/1465 602/62
2010/0050320 A1 * 3/2010 Canci ..... A41B 11/02 2/239
2010/0137763 A1 * 6/2010 Dorshow ..... A61H 7/002 601/134
2011/0054368 A1 * 3/2011 Sanders ..... A61H 1/0266 601/118
2012/0227161 A1 * 9/2012 Canci ..... A41B 11/02 2/239
2012/0232449 A1 * 9/2012 Arnstein ..... A63B 23/085 602/16
2013/0012366 A1 * 1/2013 Seitzer ..... A63B 21/065 482/105
2013/0231227 A1 * 9/2013 Ranieri ..... A63B 21/00061 482/124
2013/0303952 A1 * 11/2013 Golan ..... A43B 7/146 601/46
2014/0173940 A1 * 6/2014 Drennan ..... A43B 7/1455 36/102
2014/0206928 A1 * 7/2014 Snider-Tornetta ..... A61N 2/002 600/15
2014/0276280 A1 * 9/2014 Oller, Jr. ..... A61H 7/003 601/138
2015/0005683 A1 * 1/2015 Balducci ..... A61H 15/00 601/134
2015/0133836 A1 * 5/2015 Pollock ..... A61H 1/008 601/136
2015/0157893 A1 * 6/2015 Canevari ..... A63B 21/4015 482/129
2015/0251040 A1 * 9/2015 Pinder ..... A63B 21/4015 482/124
2015/0265450 A1 * 9/2015 Rodgers ..... A61H 1/0266 601/84
2015/0359701 A1 * 12/2015 Moyer ..... A61H 15/0092 601/131
2016/0101309 A1 * 4/2016 Schreiber ..... A63B 21/4019 482/124
2016/0256732 A1 * 9/2016 Kasner ..... A63B 21/0555
2016/0296787 A1 * 10/2016 Kamins ..... A63B 21/4013
2016/0361223 A1 * 12/2016 Muller ..... A61H 7/002
2017/0135837 A1 * 5/2017 Jara ..... A61F 5/3715
2017/0273851 A1 * 9/2017 Larmer ..... A61H 9/0092
2018/0036577 A1 * 2/2018 Leary ..... A43B 7/00
2018/0055713 A1 * 3/2018 Cromie ..... A63B 21/4007
2018/0055724 A1 * 3/2018 Slocum ..... A61H 15/02
2018/0200559 A1 * 7/2018 Papashvili ..... A63B 21/0442
2018/0228247 A1 * 8/2018 Muller ..... A43B 7/142
2018/0304134 A1 * 10/2018 Parque ..... A63B 69/0002
2019/0046393 A1 * 2/2019 Gagliano ..... A43B 7/1445 2/239
2019/0184224 A1 * 6/2019 Kasner ..... A63B 23/0355
2019/0201731 A1 * 7/2019 Nguyen ..... A63B 21/00065
2019/0216682 A1 * 7/2019 Vreeland ..... A61H 39/04
2019/0358117 A1 * 11/2019 Connelly ..... A61H 15/0092
2020/0093675 A1 * 3/2020 Hale ..... A61H 1/0266
2020/0330313 A1 * 10/2020 Schwarz ..... A61H 1/0266

OTHER PUBLICATIONS

OPTD, Tools for Fitness Knowledge and Health, Professional Catalog 35, 2016.

* cited by examiner

EXERCISE AND THERAPY DEVICES

CROSS-REFERENCE TO RELATED APPLICATION

Priority is claimed to U.S. Provisional Patent Application No. 62/697,201, filed Jul. 12, 2018, and U.S. Provisional Patent Application No. 62/814,803, filed Mar. 6, 2019, the entire contents of which are hereby incorporated by reference.

FIELD OF THE DISCLOSURE

The present disclosure relates generally to exercise and therapy devices and, in particular, relates to exercise and therapy devices that are arranged to hold a pliable object adjacent a portion of the body.

BACKGROUND

Different parts of the body may be massaged. The individual giving the massage may use their hands or a hand-held tool to massage different parts of the body.

SUMMARY

In accordance with a first example, an exercise and therapy device includes a foot covering. The foot covering includes a pocket. The exercise and therapy device includes a pliable object. The pliable object received within the pocket and arranged to be placed adjacent a foot of an individual wearing the foot covering.

In accordance with a second example, an exercise and therapy device includes a strap to receive a pliable object. The strap includes a first portion, a second portion, and a fastener carried by the first portion or the second portion. The strap to be coupled about a part of a body, via the fastener, to secure the pliable object relative thereto.

In accordance with a third example, an exercise and therapy device includes a pliable object, exercise bands, and a strap. The strap includes a pocket and apertures. The pocket arranged to receive the pliable object and the apertures arranged to receive the exercise bands. The strap to be coupled to a part of a body to enable exercises to be performed while securing a relative position between the pliable object and the part of the body.

In further accordance with the foregoing first, second, and/or third examples, an apparatus may further include any one or more of the following:

In accordance with one example, the foot covering includes an ankle support.

In accordance with another example, the pocket is arranged to position the pliable object adjacent a heel of the foot.

In accordance with another example, the ankle support includes a strap including the pocket. The strap further includes a first portion and a second portion. The pocket positioned between the first and second portions. The first and second portions to be wrapped about a portion of an individual.

In accordance with another example, further including a fastener carried by the first portion of the strap. The fastener arranged to attach the ankle support to the portion of the individual.

In accordance with another example, further including rings. The rings coupled to the foot covering and arranged to position the rings on sides of a foot of an individual.

In accordance with another example, the foot covering includes a sock.

In accordance with another example, the sock includes an open-toed sock.

In accordance with another example, the pocket is arranged to position the pliable object adjacent a ball of the foot.

In accordance with another example, further including a strap. The strap includes first and second portions. The first and second portions extend from the pocket. The first and second portions to be wrapped about the sock and a bridge of the foot.

In accordance with another example, the foot covering includes a strap. The strap includes a first portion, the pocket, and a second portion. The first and second portions coupled to and extending from the pocket. The first and second portions to be wrapped about a bridge of the foot.

In accordance with another example, the pocket includes a first pocket and the pliable object includes a first pliable object. The exercise and therapy device includes a second pliable object and the foot covering further includes a second pocket. The second pocket arranged to receive the second pliable object to place the second pliable object adjacent the foot of the individual wearing the foot covering.

In accordance with another example, the first pocket is arranged to position the first pliable object adjacent a heel of the foot and the second pocket is arranged to position the second pliable object adjacent a ball of the foot.

In accordance with another example, the foot covering includes an ankle support and a foot strap. The ankle support including the first pocket and the foot strap including the second pocket.

In accordance with another example, the ankle support is coupled to the foot strap via a central portion.

In accordance with another example, the pliable object includes protrusions.

In accordance with another example, the protrusions are arranged on a first portion of the pliable object. A second portion of the pliable object not including protrusions. The second portion to be arranged to face the pocket.

In accordance with another example, the strap includes a pocket. The pocket to receive the pliable object.

In accordance with another example, the fastener is a first fastener. Further including a second fastener. The second fastener arranged to secure the pliable object in the pocket of the strap.

In accordance with another example, the strap is one or more of an ankle strap, a foot strap, an elbow strap, or a knee strap.

In accordance with another example, the strap carries rings that are to receive exercise bands.

In accordance with another example, the strap includes an ankle support and a foot strap. The ankle support including the pocket and the foot strap including a second pocket.

In accordance with another example, the strap includes an ankle strap, a foot strap, and arced portions. The pocket being formed by a portion of the foot strap and the arced portions.

In accordance with another example, the foot strap includes a first portion and a second portion, the first portion carrying a buckle. The second portion of the foot strap adapted to be received by the buckle.

DETAILED DESCRIPTION

Although the following text discloses a detailed description of example methods, apparatus and/or articles of manufacture, it should be understood that the legal scope of the property right is defined by the words of the claims set forth at the end of this patent. Accordingly, the following detailed description is to be construed as examples only and does not describe every possible example, as describing every possible example would be impractical, if not impossible. Numerous alternative examples could be implemented, using either current technology or technology developed after the filing date of this patent. It is envisioned that such alternative examples would still fall within the scope of the claims.

Figure 1:
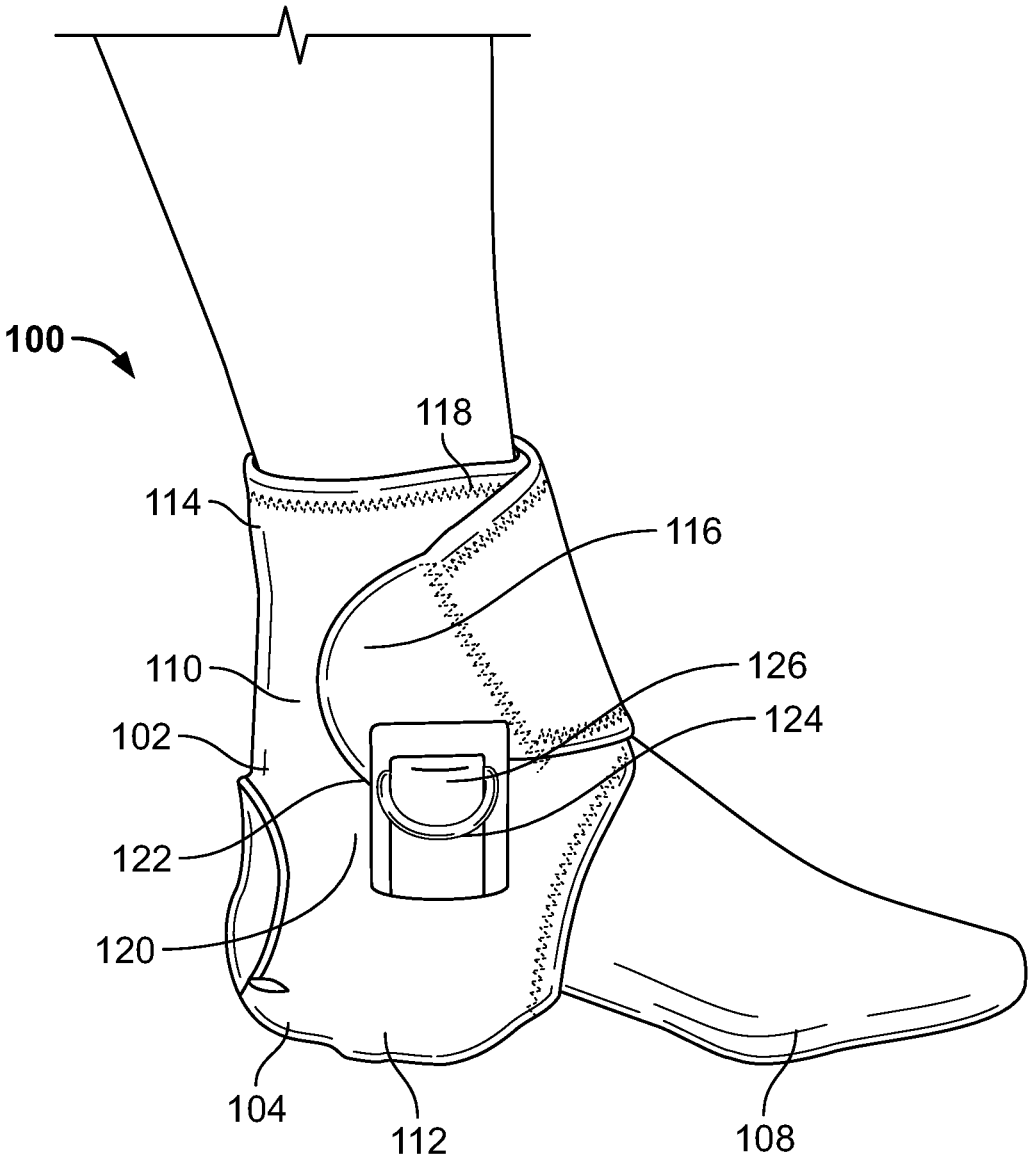
FIG. 1 illustrates an exercise and therapy device assembled in accordance with the teachings of a first disclosed example of the present disclosure including an ankle support and a pocket arranged to receive a pliable object.

FIG. 1 illustrates an exercise and therapy device 100 assembled in accordance with the teachings of a first disclosed example of the present disclosure. The exercise and therapy device 100 includes a foot covering 102 having a pocket 104. A pliable object 106 (See, FIG. 2) is received within the pocket 104. The pliable object 106 is arranged to be placed adjacent a foot 108 of an individual wearing the foot covering 102. The pliable object 106 may be formed of a flexible resilient material that changes shape and/or softens under pressure.

In the example shown, the foot covering 102 is an ankle support 110 and the pocket 104 is arranged to position the pliable object 106 adjacent a heel 112 of the foot 108. The pliable object 106 may be retained within the pocket 104 using a fastener such as adhesive, a cord extending through the pliable object 106 and is coupled to the foot covering 102, netting or mesh that covers the pliable object 106 and is coupled to the foot covering 102 and/or any other device that permanently or temporarily attaches the pliable object 106 to the foot covering 102.

The ankle support 110 includes a strap 114. The strap 114 may be made of fabric, an elastic material, a rubber material, nylon, neoprene, an elastic bandage, a material having self-adhesion properties and/or plastic. The strap 114 forms the pocket 104 and includes first and second portions 116, 118 (the portions 116, 118 are best visible in FIG. 2). The pocket 104 is arranged between the first and second portions 116, 118.

To attach the ankle support 110 to the foot 108 and to secure the pliable object 106 against the heel 112, the portions 116, 118 are wrapped about the foot 108 and/or an associated ankle 120. The first portion 116 may be longer than the second portion 118. The relative length of the first portion 116 to the second portion 118 may allow the first portion 116 to be further wrapped about the ankle 120 to provide enhanced support. In the example shown, the first portion 116 includes a fastener 122 that may attach the ankle support 110 to the foot 108. The fastener 122 may be a hook-and-loop fastener or another type of fastener.

When the ankle support 110 is attached to the foot 108, exercises or other activities can be performed while a relative position between the pliable object 106 and the heel 112 is substantially secured. Some of the exercises stretch connective tissue, fascia, tendons, muscles, ligaments and joints to stimulate and increase the number of proprioceptors and nerve cells of the corresponding body part.

The ankle support 110 also includes rings 124. The rings 124 may be made of metal, plastic, or fabric. The rings 124 are arranged on the sides of the ankle 120. In the example shown, the rings 124 are coupled to the ankle support 110 using a loop 126, where one of the loops 126 is coupled on the first portion 116 of the strap 114 and another one of the loops 126 may be coupled on the opposing side of the ankle support 110 in a similar manner.

Exercise bands may be attached to the rings 124 to allow additional exercises to be performed using the exercise and therapy device 100. Alternatively, the rings 124 may not be included and the loops 126 themselves may be used during the exercise activities using the elastic bands.

Figure 2:
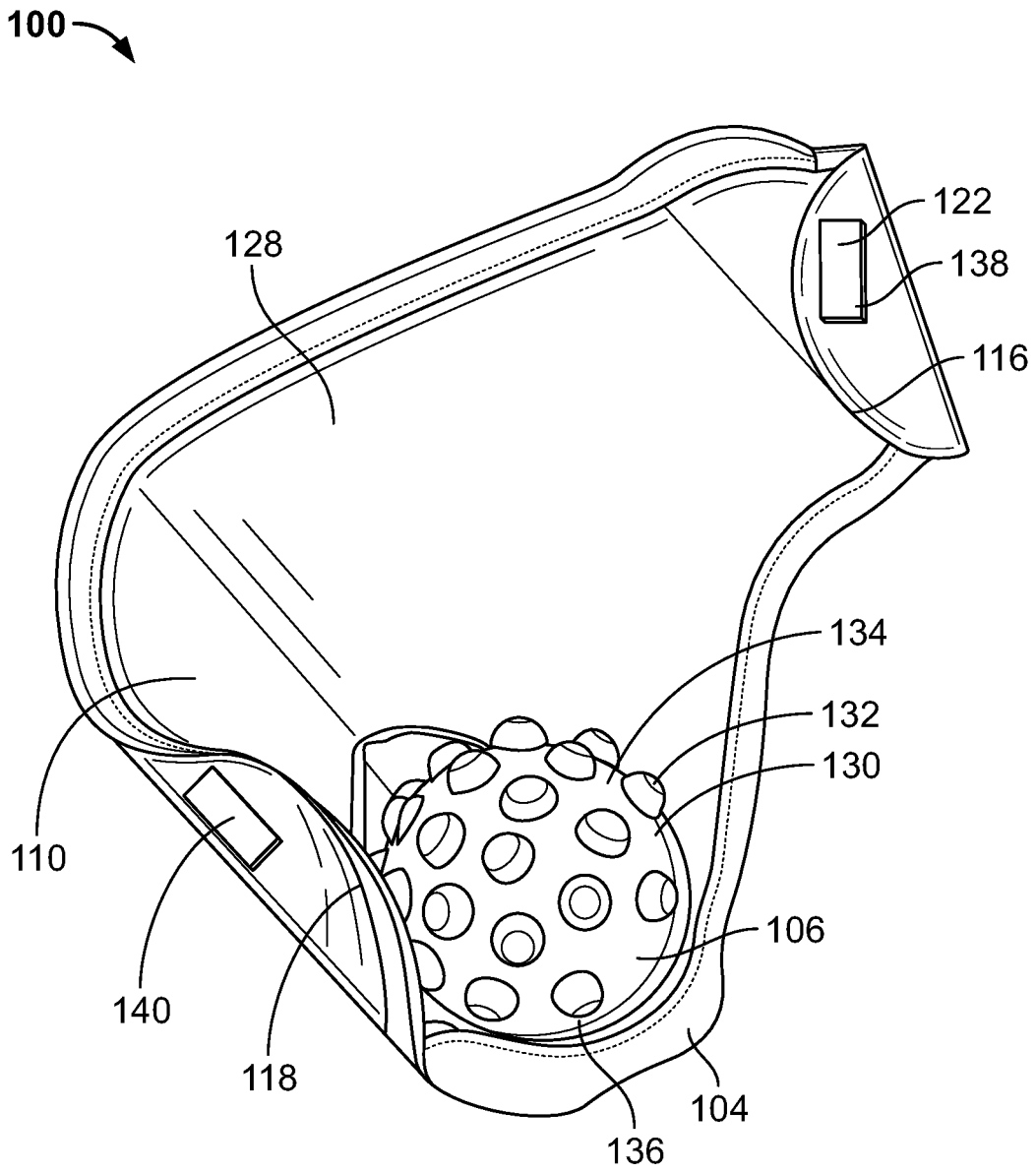
FIG. 2 illustrates an isometric view of the exercise and therapy device of FIG. 1 illustrating the pliable object received within the pocket.

FIG. 2 illustrates that the ankle support 110 includes a back heel support 128. The back heel support 128 is arranged to extend above the heel 112 to provide increased stability when the ankle support 110 is worn. In the example shown, the pliable object 106 is an exercise ball 130 having protrusions 132. The exercise ball 130 may include a first portion 134 and a second portion 136. The first portion 134 faces away from the pocket 104 and the second portion 136 faces the pocket 104. The protrusions 132 may be arranged on the first portion 134 of the exercise ball 130 but may not be arranged on the second portion 136 of the exercise ball 130. Not providing the protrusions 132 on the second portion 136 of the exercise ball 130 facing the ground may increase the stability of the individual using the exercise and therapy device 100 and standing on the pliable object 106.

The fastener 122 is shown in FIG. 2 including a first-fastener portion 138 and a second-fastener portion 140. The first-fastener portion 138 is carried by the first portion 116 of the strap 114 and the second-fastener portion 140 is carried by the second portion 118 of the strap 114. The first-fastener portion 138 may be hooks of a hook-and-loop fastener and the second-fastener portion 140 may be loops of a hook-and-loop fastener.

Figure 3:
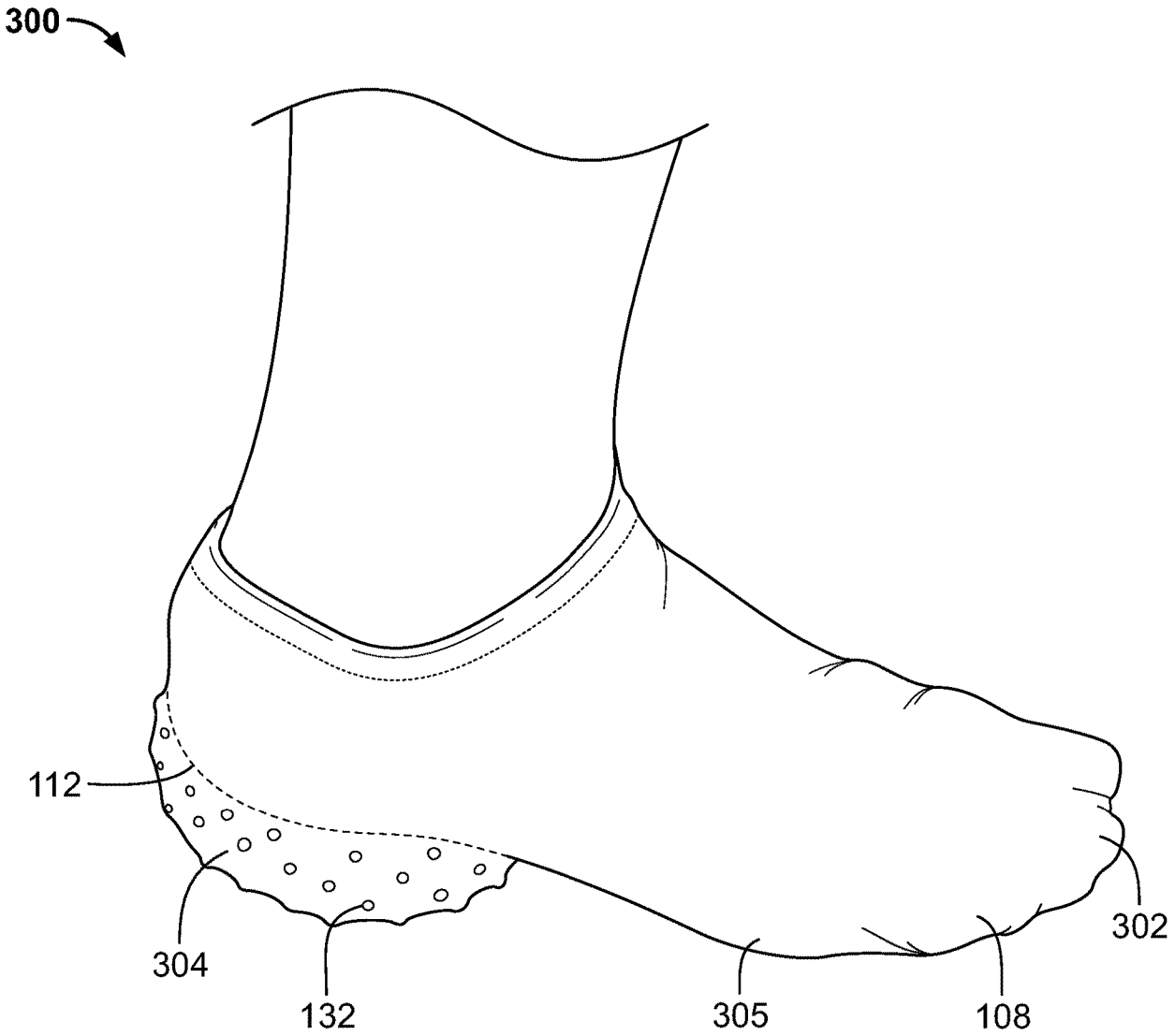
FIG. 3 illustrates an exercise and therapy device assembled in accordance with the teachings of a second disclosed example of the present disclosure including a sock having a pocket arranged to receive a pliable object.

FIG. 3 illustrates an exercise and therapy device 300 assembled in accordance with the teachings of a second disclosed example of the present disclosure. The exercise and therapy device 300 includes a foot covering 302 having a pocket 304. Like the exercise and therapy device 100 of FIG. 1, the pocket 304 is arranged to receive the pliable object 106 and to place the pliable object 106 adjacent the heel 112 of the individual wearing the foot covering 302. The heel 112 is represented by dashed lines through the foot covering 302 and the foot covering 302 is shown conforming about the protrusions 132 of the pliable object 106. In the example shown, the foot covering 302 is a sock 305.

Figure 4:
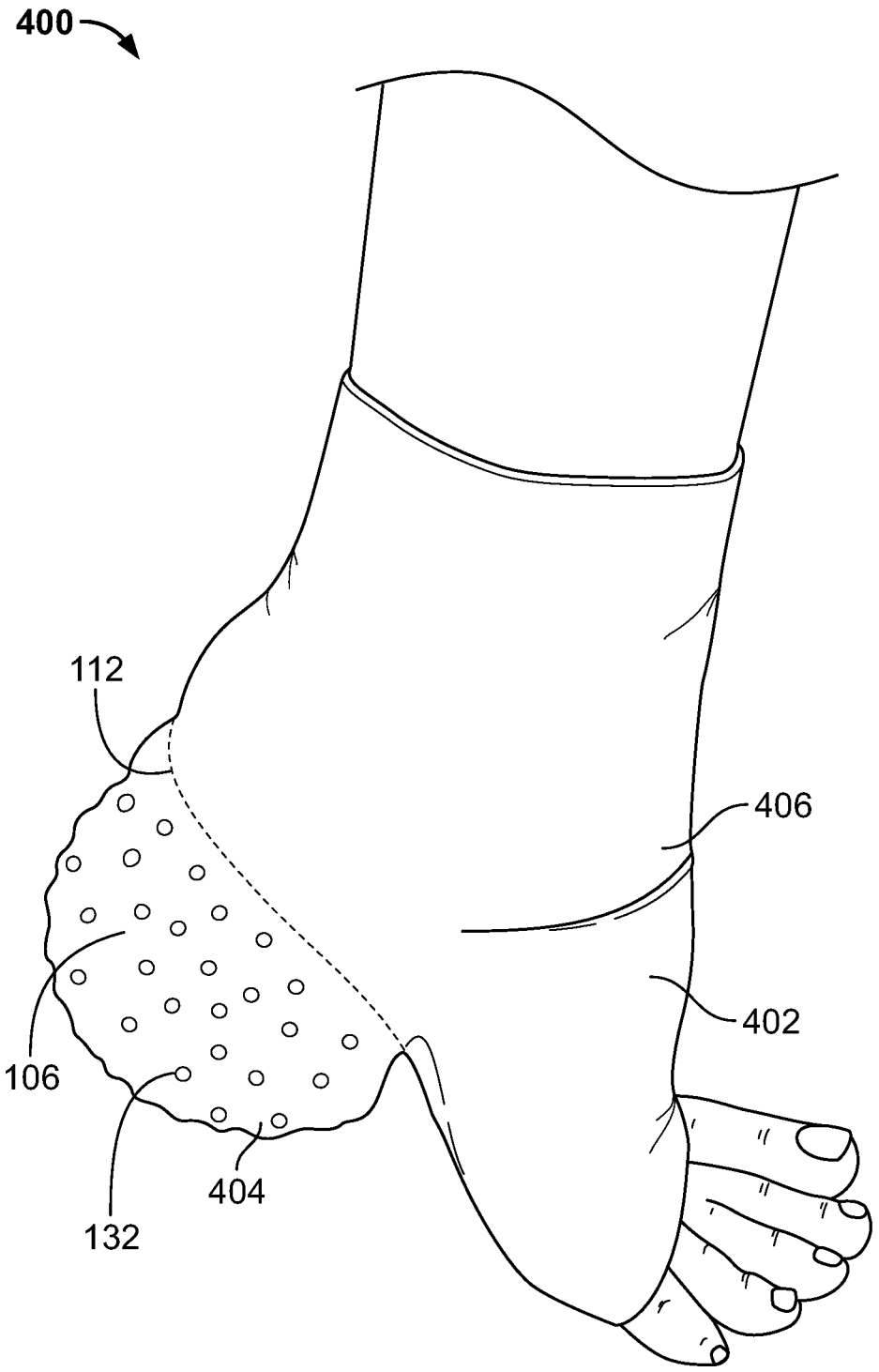
FIG. 4 illustrates an exercise and therapy device assembled in accordance with the teachings of a third disclosed example including a sock having a pocket arranged to receive a pliable object.

FIG. 4 illustrates an exercise and therapy device 400 assembled in accordance with the teachings of a third disclosed example of the present disclosure. The exercise and therapy device 400 includes a foot covering 402 having a pocket 404. Like the examples disclosed above, the pocket 404 is arranged to receive the pliable object 106 and to place the pliable object 106 adjacent the heel 112 represented in dashed lines. In the example shown, the foot covering 402 is an open-toed sock 406. The sock 406 may be formed of any suitable material such as one or more of cotton, wool, nylon, acrylic, polyester, spandex, olefins, etc.

Figure 5:
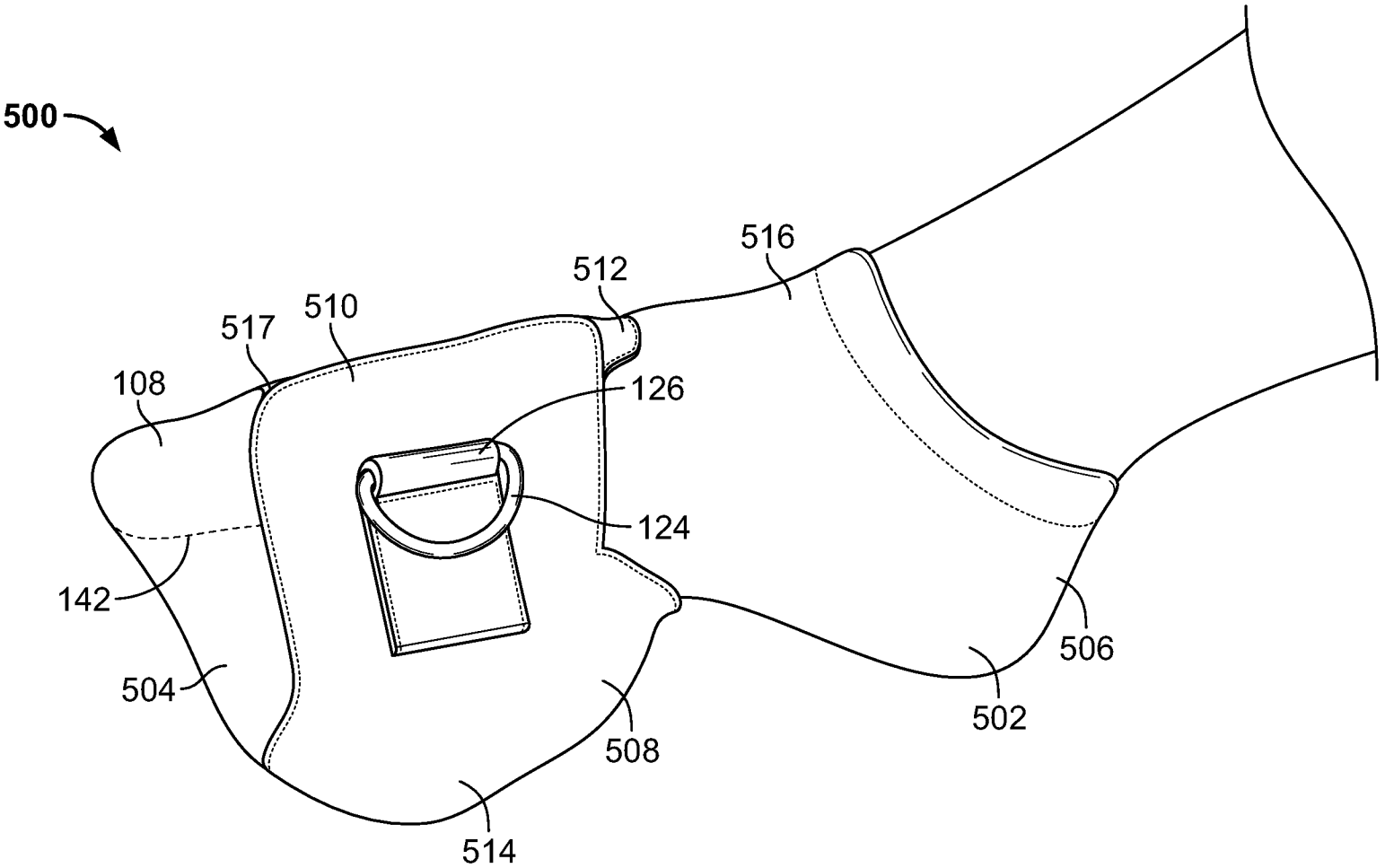
FIG. 5 illustrates an exercise and therapy device assembled in accordance with the teachings of a fourth disclosed example including a sock and a strap arranged to receive a pliable object.

FIG. 5 illustrates an exercise and therapy device 500 assembled in accordance with the teachings of a fourth disclosed example of the present disclosure is shown. The exercise and therapy device 400 includes a foot covering 502 having a pocket 504. The pocket 504 is arranged to receive the pliable object 106 and to place the pliable object 106 adjacent a ball 142 of the foot 108 represented in dashed lines.

In the example shown, the foot covering 502 includes a sock 506 and a strap 508. The strap 508 includes a first portion 510, a second portion 512 (the portions 510, 512 are best visible in FIG. 6) and a central portion 514. The central portion 514 covers the pocket 504 formed by the sock 506 and may be coupled to the sock 506 via stitching or another fastener. Alternatively, the central portion 514 may form at least a portion of the pocket 504. The first and second portions 510, 512 of the strap 508 are coupled to and extend from the central portion 514 and, thus, extend from the pocket 504.

In the example shown, to secure the pliable object 106 relative to and/or against the ball 142 of the foot 108, the first and second portions 510, 512 are wrapped about the sock 506 and a bridge 516 of the foot 108. Specifically, the first portion 510 and/or the second portion 512 include a fastener 517 that is arranged to attach the strap 508 about the foot 108. The fastener 517 may be a hook-and-loop fastener or another type of fastener.

When the strap 508 is attached to the foot 108, exercises can be performed. Some of these exercises place the foot 108 in dorsiflexion, flantar flexion or a neutral position while massaging the foot 108 during movement. In some examples, raising the front of the foot 108 (the toe) relative to the back of the foot 108 (the heel) places a subtle but effective stretch on the plantar fascia, Achilles tendon and Gastrocnemius and Soleus (calf muscles) and the back of the body up to the head, referred to as "the back line." While the exercises are performed, the relative position between the strap 508 and the target tissue may be maintained, enabling press and release exercises to be performed.

Figure 6:
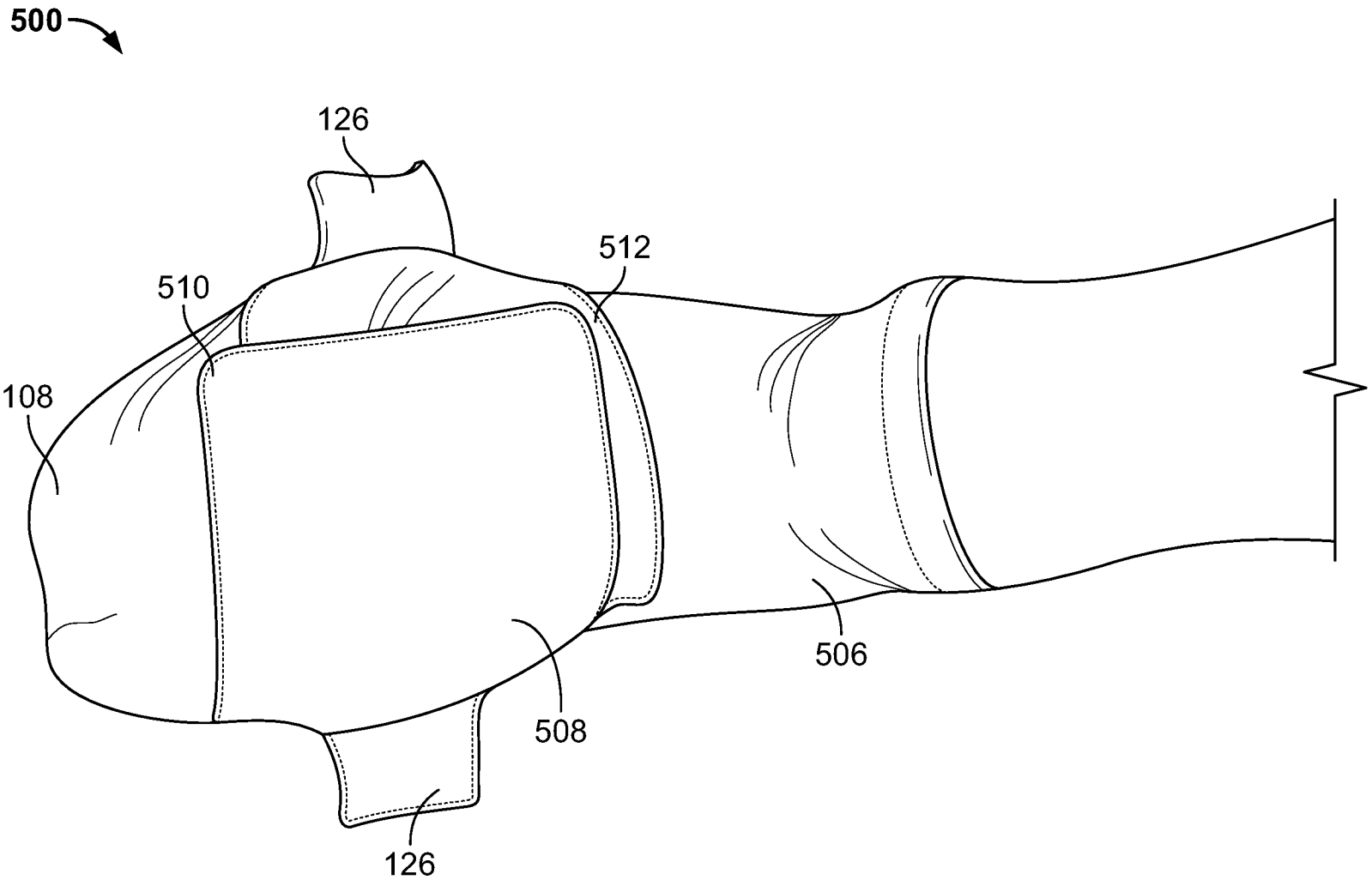
FIG. 6 illustrates a top-isometric view of the exercise and therapy device of FIG. 5.

FIG. 6 illustrates a top view of the exercise and therapy device 502 of FIG. 5 illustrating the first portion 510 of the strap 508 overlapping the second portion 512 of the strap 508. In the example shown, the central portion 514 of the strap 508 is coupled at the pocket 504 and the portions 510, 512 are movably coupled relative to the pocket 504. The portions 510, 512 are movable between a non-overlapping position where ends of the portions 510, 512 do not overlap and an overlapping position where the ends of the portions 510, 512 overlap (as shown in FIG. 6).

While the loops 126 and the corresponding rings 124 are carried by the strap 508 and positioned toward the middle of the foot 108, the loops 126 and the rings 124 may be in different positions. For example, the loops 126 and the rings 124 may be positioned toward the back of the foot 108 or toward the front of the foot 108, where the loops 126 may be coupled to the strap 508 or coupled to the sock 506.

Figure 7:
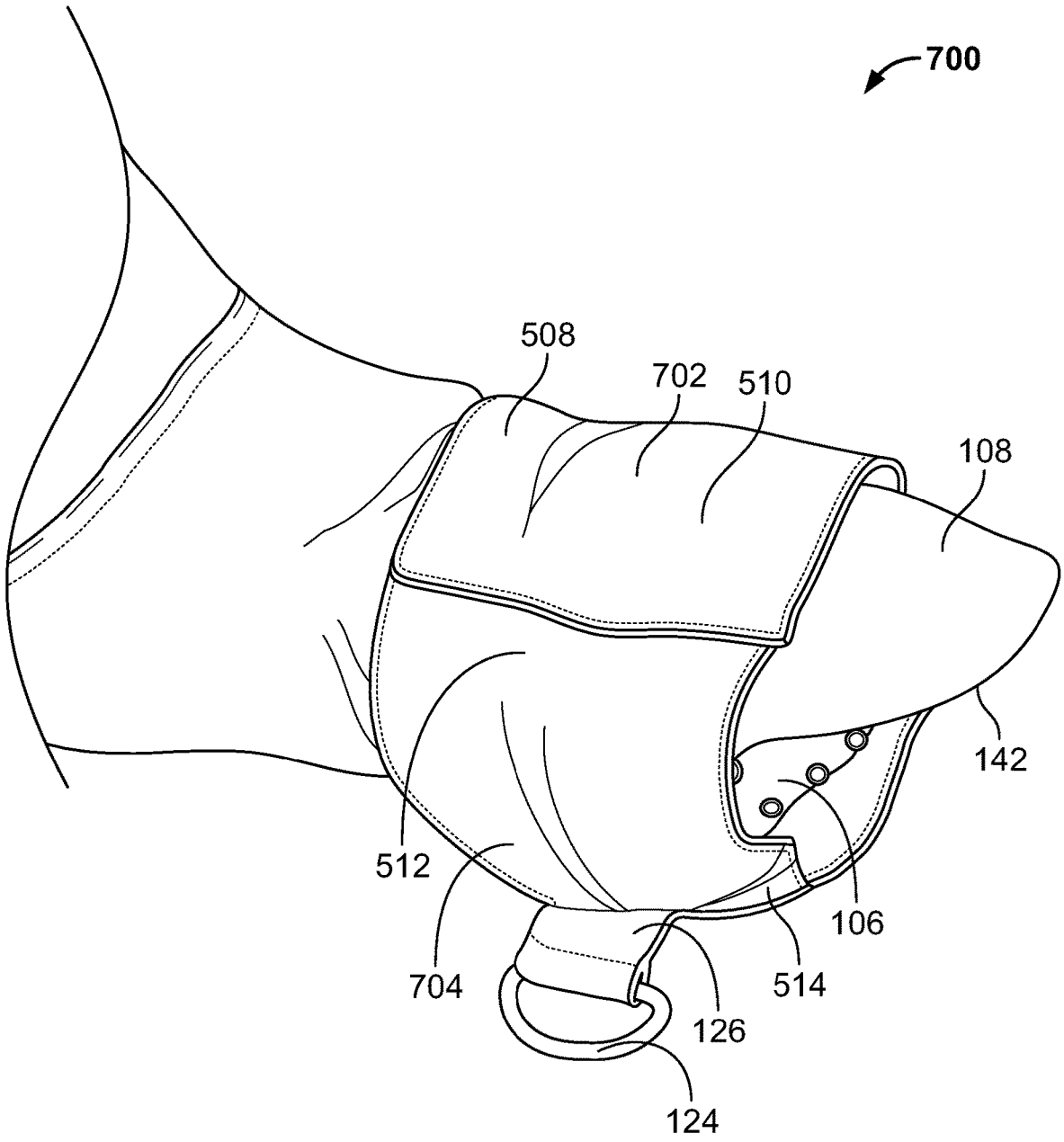
FIG. 7 illustrates an exercise and therapy device assembled in accordance with the teachings of a fifth disclosed example including a foot covering having a pocket arranged to receive a pliable object.

FIG. 7 illustrates an exercise and therapy device 700 assembled in accordance with the teachings of a fifth disclosed example of the present disclosure. The exercise and therapy device 700 includes a foot covering 702 having a pocket 704. Like the examples disclosed above, the pocket 704 is arranged to receive the pliable object 106 and to place the pliable object 106 adjacent the ball 142 of the foot 108. In the example shown, the foot covering 702 includes the strap 508 but does not include the sock 506. Thus, the central portion 514 of the foot covering 702 of FIG. 7 forms the pocket 704.

Figure 8:
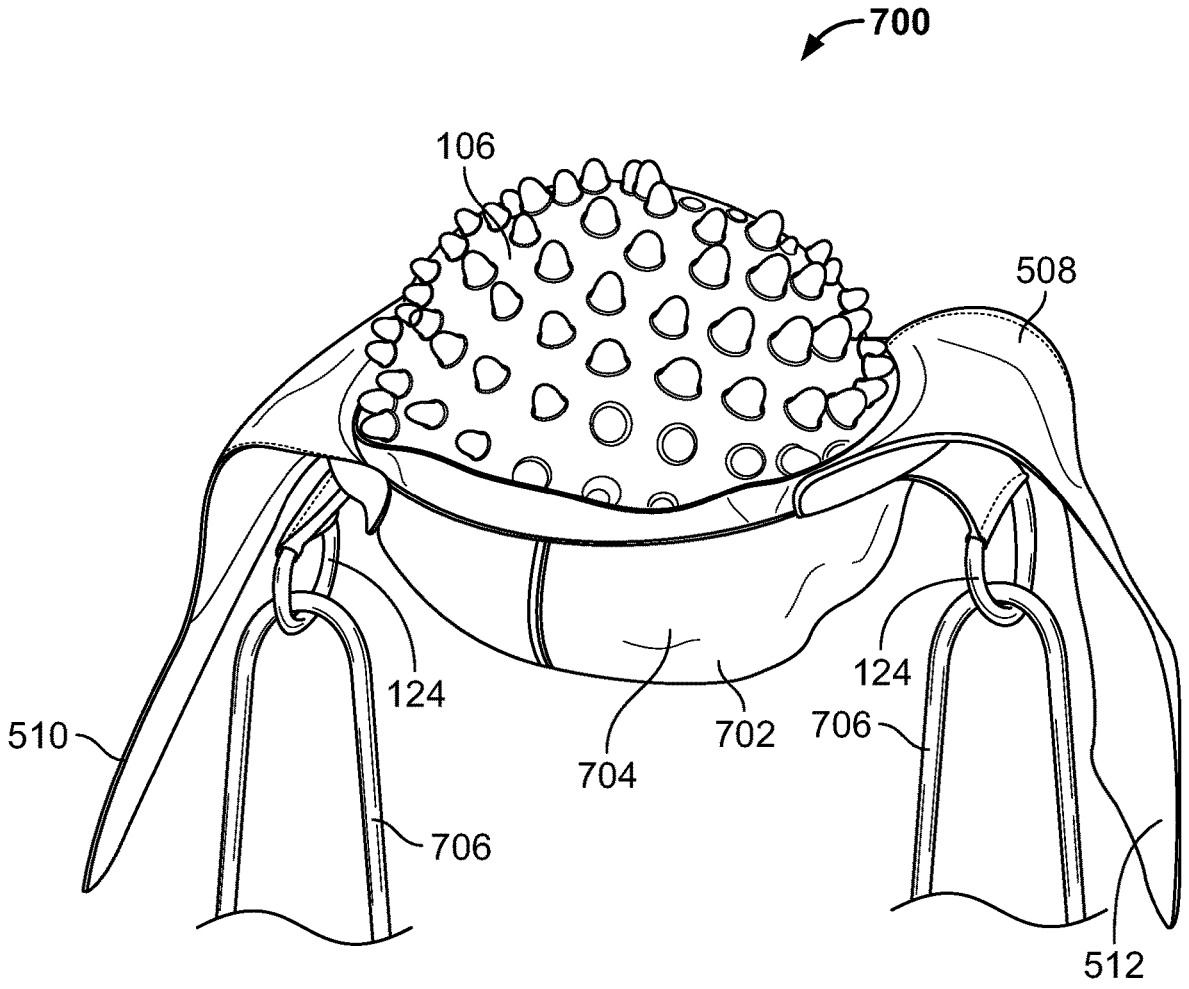
FIG. 8 illustrates an isometric view of the exercise and therapy device of FIG. 7 including exercise bands that extend through rings of the exercise and therapy device.

FIG. 8 illustrates an isometric view of the exercise and therapy device 700 of FIG. 7 that illustrates the portions 510, 512 of the strap 508 and the pliable object 106 received within the pocket 704. Exercise bands 706 extend through the rings 124. The exercise bands 706 may be used when performing different exercises with the exercise and therapy device 700. Some of these exercises may include placing the exercise bands 706 in tension when the foot 108 is on the ground or reducing an amount of tension within the exercise band 706 when the foot 108 is lifted off the ground. When the foot 108 is on the ground, the pliable object 106 is positioned between the foot 108 and the ground. When the foot 108 is lifted off of the ground, the strap 508 secures the relative position between the pliable object 106 and the foot 108.

Figure 9:
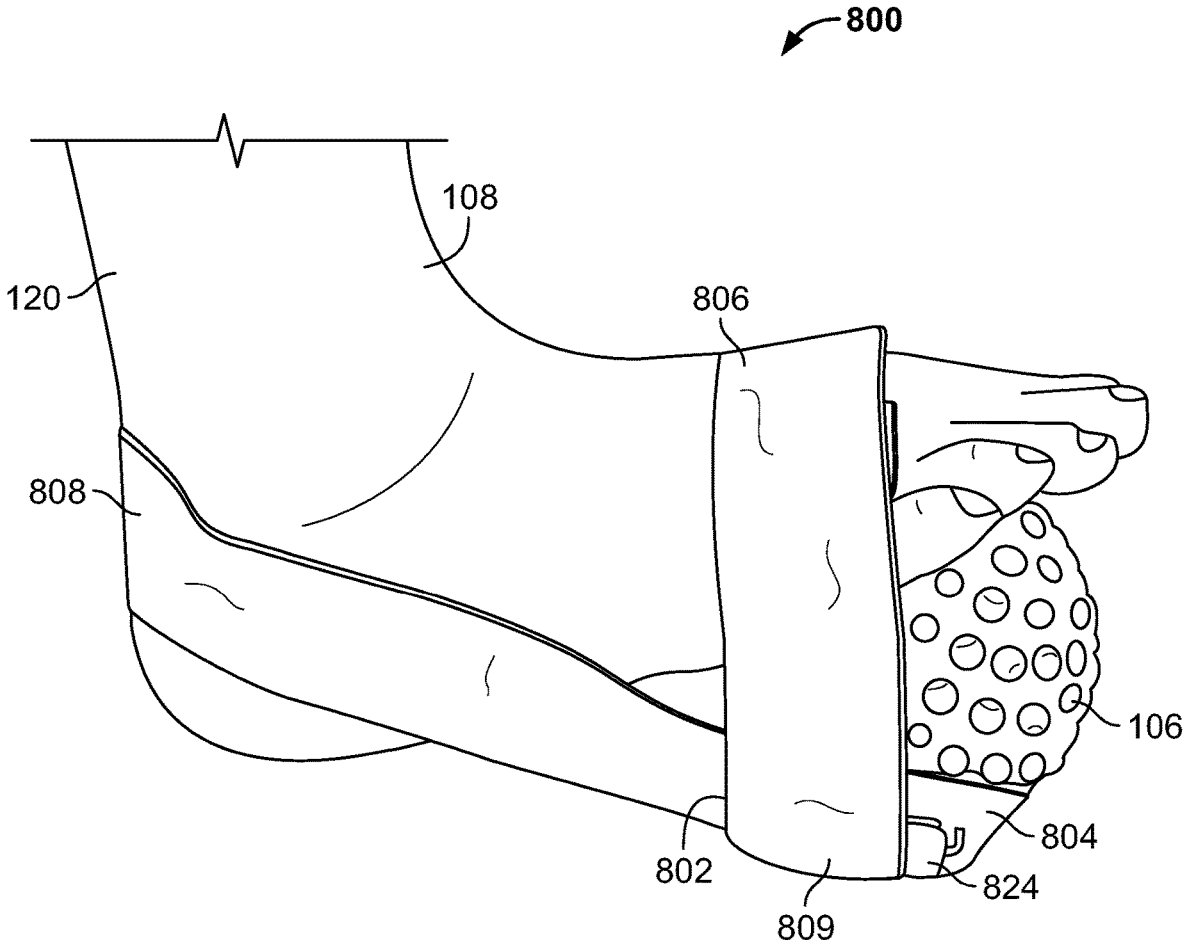
FIG. 9 illustrates an exercise and therapy device assembled in accordance with the teachings of a seventh disclosed example of the present disclosure including a pocket, a front-foot strap and an ankle strap, where the pocket is arranged to receive a pliable object.

FIG. 9 illustrates an exercise and therapy device 800 assembled in accordance with a sixth disclosed example of the present disclosure. The exercise therapy device 800 includes a foot covering 802 having a pocket 804, a first strap 806 and a second strap 808. The first strap 806 is similar to the strap 508 and is wrapped about a front of the foot 108. The second strap 808 is an ankle strap that extends from sides 809 of the pocket 804 about the ankle 120. In the example shown, the first strap 806 is adjustable to secure the exercise and therapy device 800 to the foot 108 and the second strap 808 is not adjustable (but may have elastic characteristics). Alternatively, the second strap 808 may also be adjustable. The first strap 806 and/or the second strap 808 may be formed of any suitable material such as a material having elastic properties.

Figure 10:
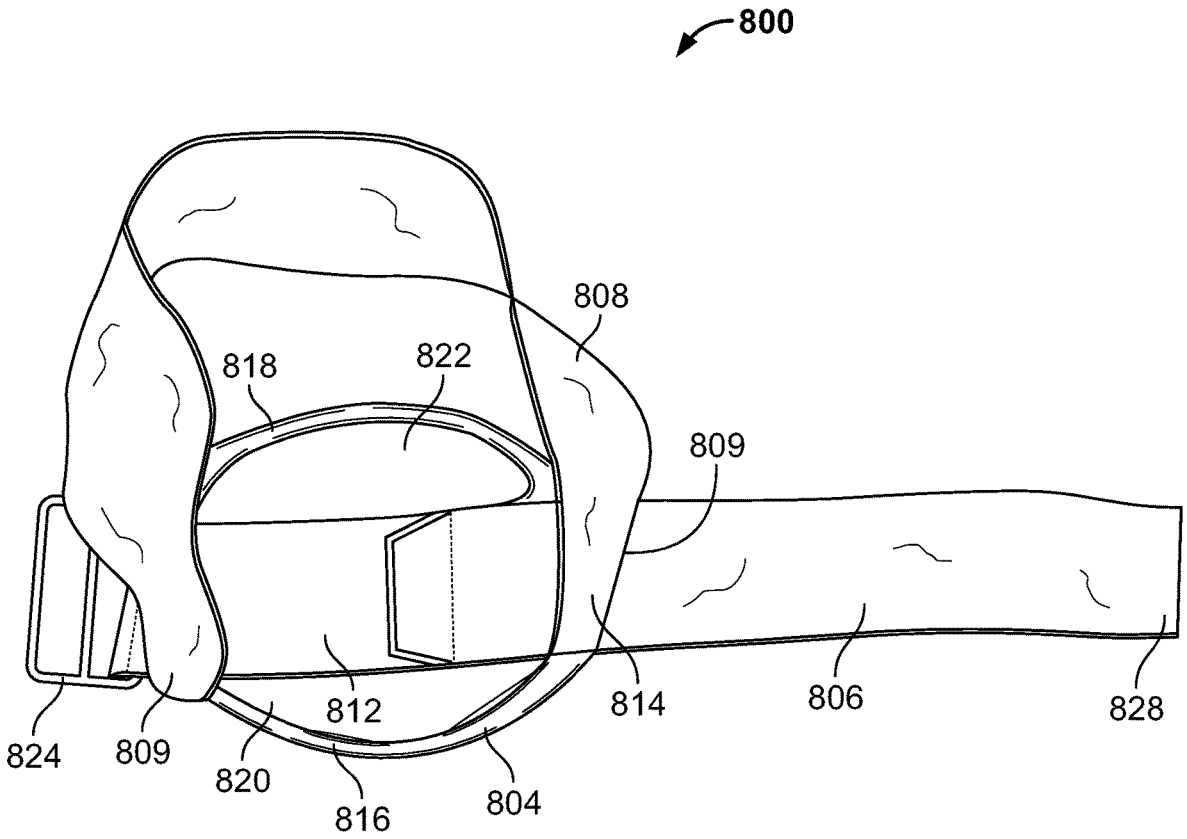
FIG. 10 illustrates an isometric view of the exercise and therapy device of FIG. 9 illustrating the pocket being formed by the straps and arc-shaped portions.

FIG. 10 illustrates that the pocket 804 is formed by a portion 812 of the first strap 806, a portion 814 of the second strap 808 and arced portions 816, 818. Gaps 820, 822 are defined between the portion 812 of the first strap 806 and the arced portions 816, 818. The foot covering 802 also includes a buckle 824. To couple the first strap 806 about the front of the foot 108, the buckle 824 is attached to one of the sides 809 of the foot covering 802. An end 828 of the first strap 806 may be threaded through the buckle 824.

Figure 11:
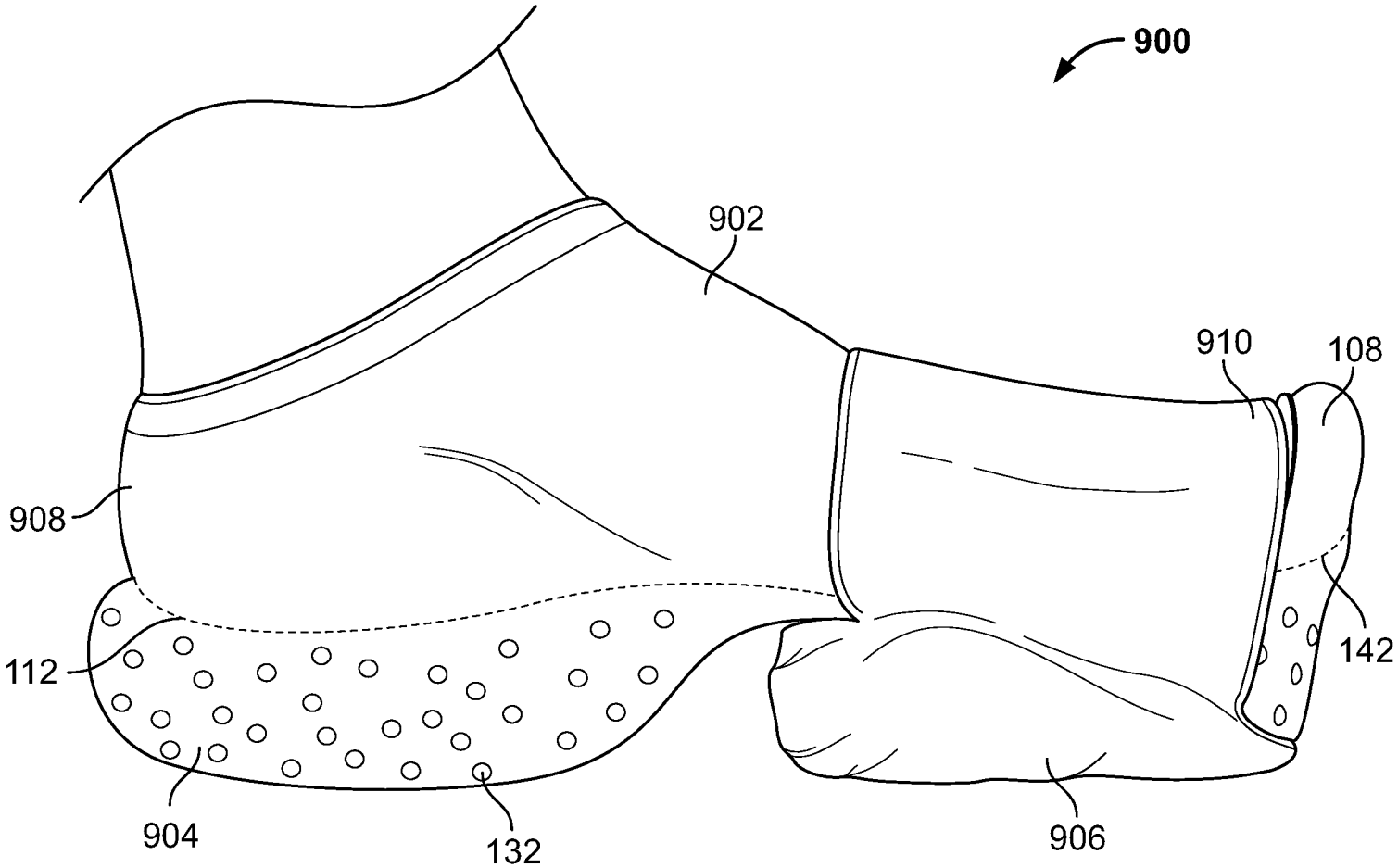
FIG. 11 illustrates an exercise and therapy device assembled in accordance with the teachings of a seventh disclosed example including a foot covering having a first pocket and a second pocket, where the pockets are arranged to receive pliable objects.

FIG. 11 illustrates an exercise and therapy device 900 assembled in accordance with the teachings of a seventh disclosed example of the present disclosure. The exercise and therapy device 900 includes a foot covering 902 having a first pocket 904 and a second pocket 906.

In the example shown, the foot covering 902 is a sock 908 and a strap 910. The strap 910 is substantially similar to the strap 508 of the exercise and therapy device 500 of FIG. 5, the first pocket 904 is substantially similar to the pocket 304 of the exercise and therapy device 300 of FIG. 3 and the second pocket 906 is substantially similar to the pocket 504 of the exercise and therapy device 500 of FIG. 5. Thus, the first pocket 904 is arranged to receive a pliable object to place the pliable object adjacent the heel 112 of the foot 108 and the second pocket 904 is arranged to receive a pliable object to place the pliable object adjacent the ball of the foot 108. The pliable objects received within the respective pockets 904, 906 may be the same or different. For example, the pliable objects may be different sizes, may be different shapes, have different pliability, have different protrusions, have differently placed protrusions, may or may not have protrusions, etc. The shapes may include a triangular prism, a cube, a cuboid, a sphere, a cylinder, a rectangular prism, a spheroid, etc.

Figure 12:
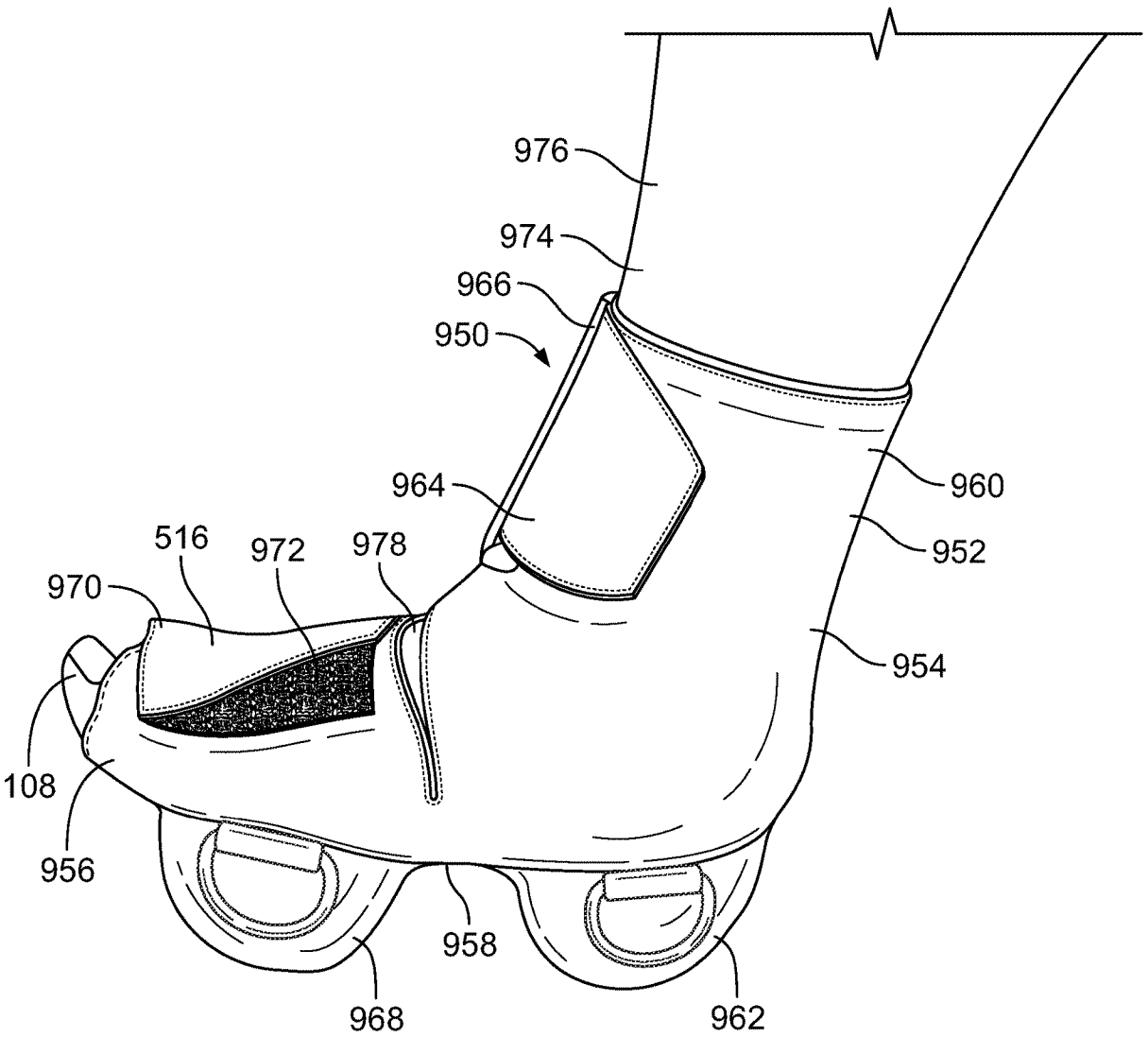
FIG. 12 illustrates an exercise and therapy device assembled in accordance with the teachings of an eighth disclosed example of the present disclosure including an ankle support including a first pocket and a foot strap including a second pocket.

FIG. 12 illustrates an exercise and therapy device 950 assembled in accordance with the teachings of an eighth disclosed example of the present disclosure. The exercise and therapy device 950 includes a foot covering 952 including an ankle support 954 and a foot strap 956 that are coupled via a central portion 958 of the foot covering 952. The ankle support 954 includes a back-heel support 960, a first pocket 962 and a pair of straps 964, 966 and the foot strap 956 includes a second pocket 968 and a pair of straps 970, 972. In the example shown, the pockets 962, 968 are receiving the pliable objects 106, the straps 964, 966 of the ankle support 954 are wrapped about a portion 974 of a leg 976 of an individual and the straps 970, 972 of the foot strap 656 are wrapped about the bridge 516 of the foot 108. When the straps 964, 966 and the straps 970, 972 are coupled as shown in FIG. 12, a gap 978 is provided between the straps 964, 966.

Figure 13:
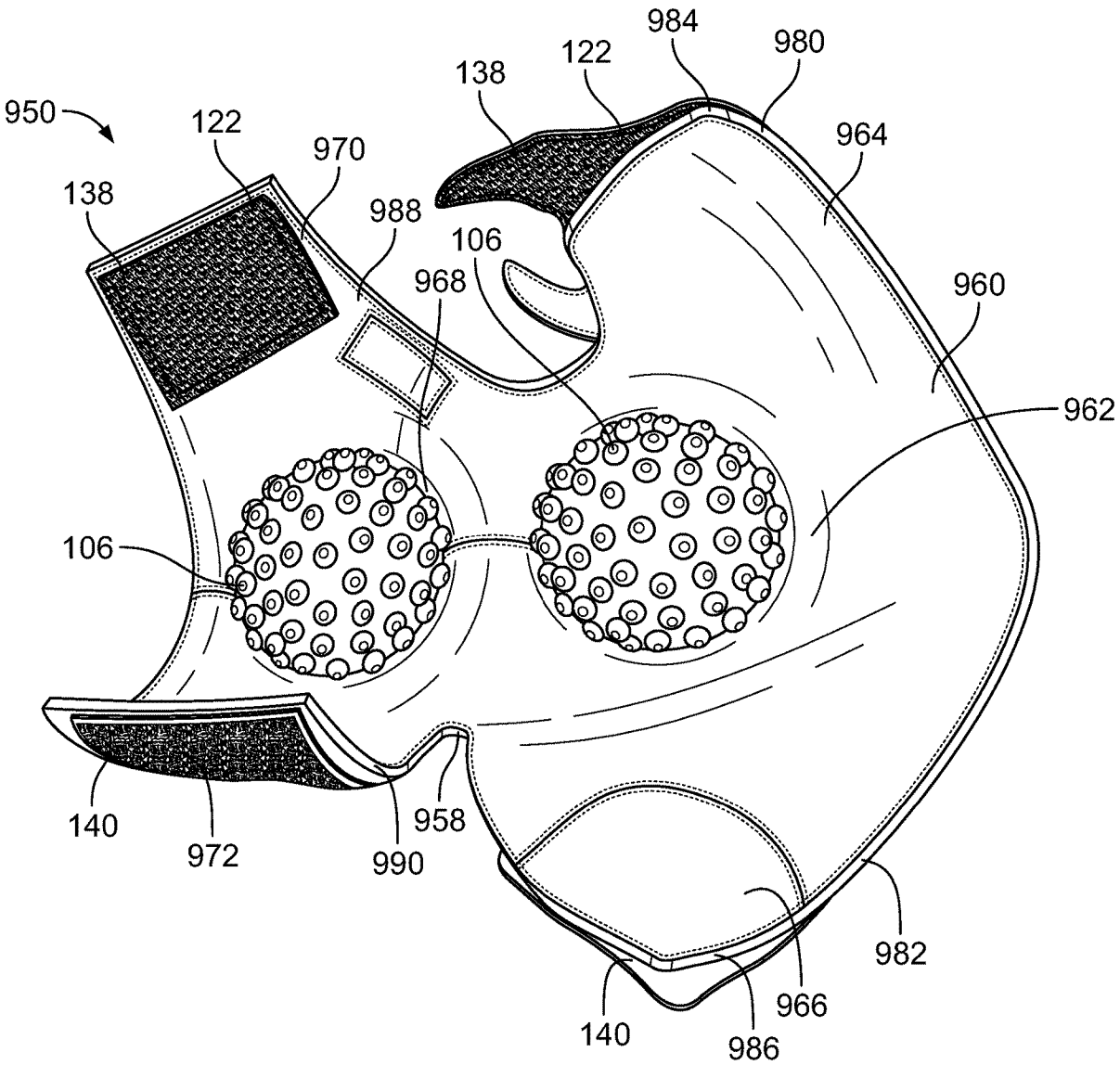
FIG. 13 illustrates an interior isometric view of the exercise and therapy device of FIG. 12 illustrating pliable objects received within the first and second pockets.

FIG. 13 illustrates an isometric view of the exercise and therapy device 950 of FIG. 12 illustrating the pliable objects 106 received within the first and second pockets 962, 968. In the example shown, the straps 964, 966 of the ankle support 954 have contoured edges 980, 982 that are arc-shaped and a width of the central portion 958 is less than a width between portions 984, 986 of the straps 964, 966. Additionally, in the example shown, the countered edges 980, 982 of the ankle support 954 and contoured edges 988, 990 of the foot strap 656 form a V-shape or a U-shape.

Figure 14:
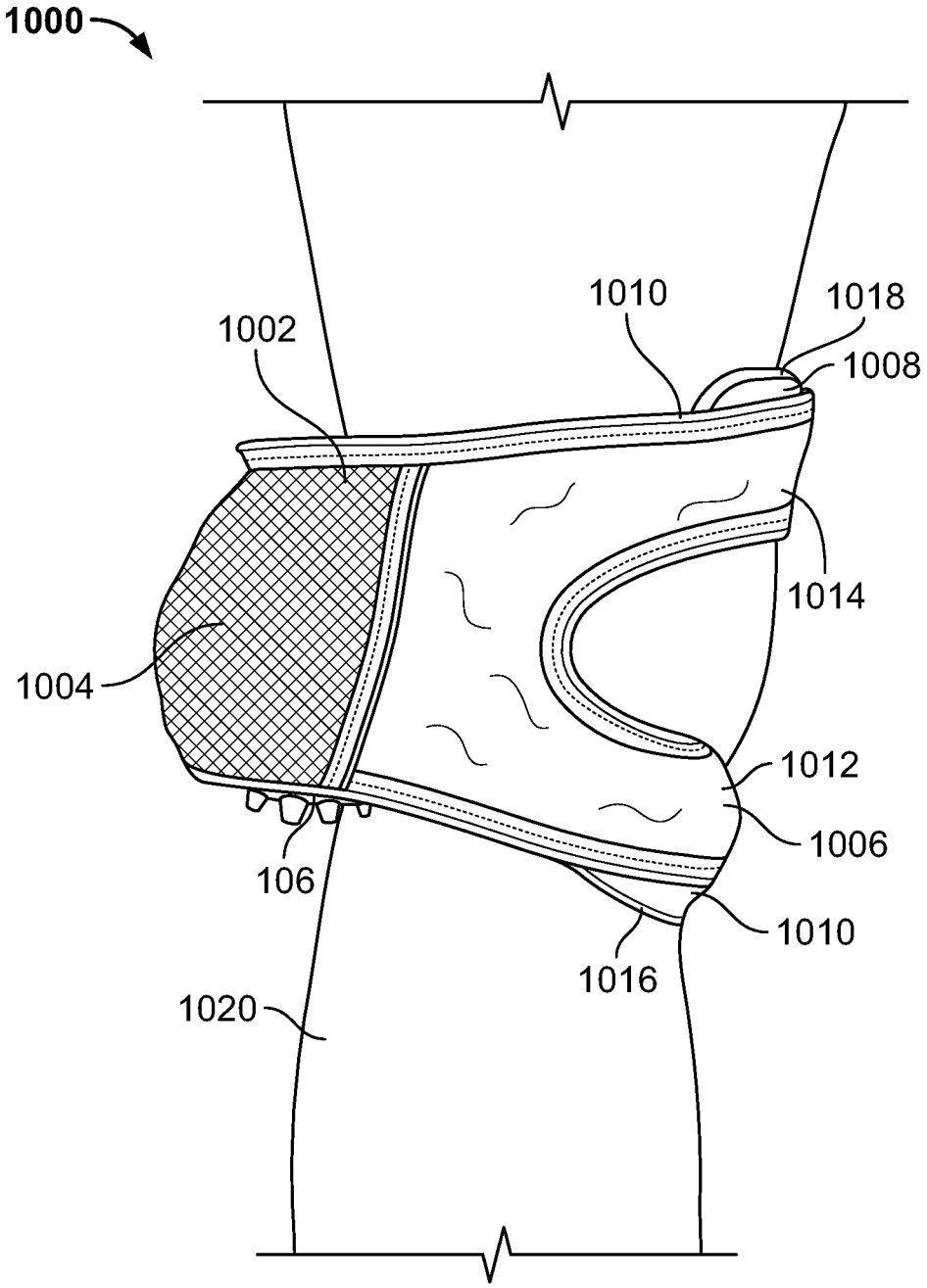
FIG. 14 illustrates an exercise and therapy device assembled in accordance with the teachings of an ninth disclosed example including a strap arranged to receive a pliable object.

FIG. 14 illustrates an exercise and therapy device 1000 assembled in accordance with the teachings of a ninth disclosed example of the present disclosure. The exercise and therapy device 1000 includes a strap 1002. The strap 1002 includes a pocket 1004. Like the other examples disclosed, the pocket 1004 is arranged to receive the pliable object 106.

The strap 1002 includes a first portion 1006 and a second portion 1008. A fastener 1010 is carried by one or more of the first portion 1006 or the second portion 1008. The fastener 1010 may be a hook-and-loop fastener. Thus, the first portion 1006 may carry the hook of the hook-and-loop fastener and the second portion 1008 may carry the loop of the hook-and-loop fastener.

In the example shown, the first portion 1006 includes first and second sub-portions 1012, 1014 and the second portion 1008 includes third and fourth sub-portions 1016, 1018. When the strap 1002 is attached to a leg 1020 of an individual, the first sub-portion 1012 may overlap the third sub-portion 1016 and the second sub-portion 1014 may overlap the fourth sub-portion 1018. Specifically, the first and third sub-portions 1012, 1016 are positioned about the calf and the second and fourth sub-portions 1014, 1018 are positioned about the thigh. The strap 1002 may be formed of an elastic material that conforms about the pliable object 106 and/or provides support to the body part about which the strap 1002 is wrapped When the strap 1002 and the pliable object 106 are secured to the leg 1020, exercises can be performed. Some exercises include lifting the leg 1020 off of the ground and bending the leg 1020 or kneeling on the ground. While the exercise and therapy device 1000 is shown being secured to the leg 1020 of an individual at or adjacent the knee, the exercise and therapy device 1000 may be secured to other parts of the body. For example, the exercise and therapy device 1000 may be secured to the arm of the individual at or adjacent the elbow.

Figure 15:
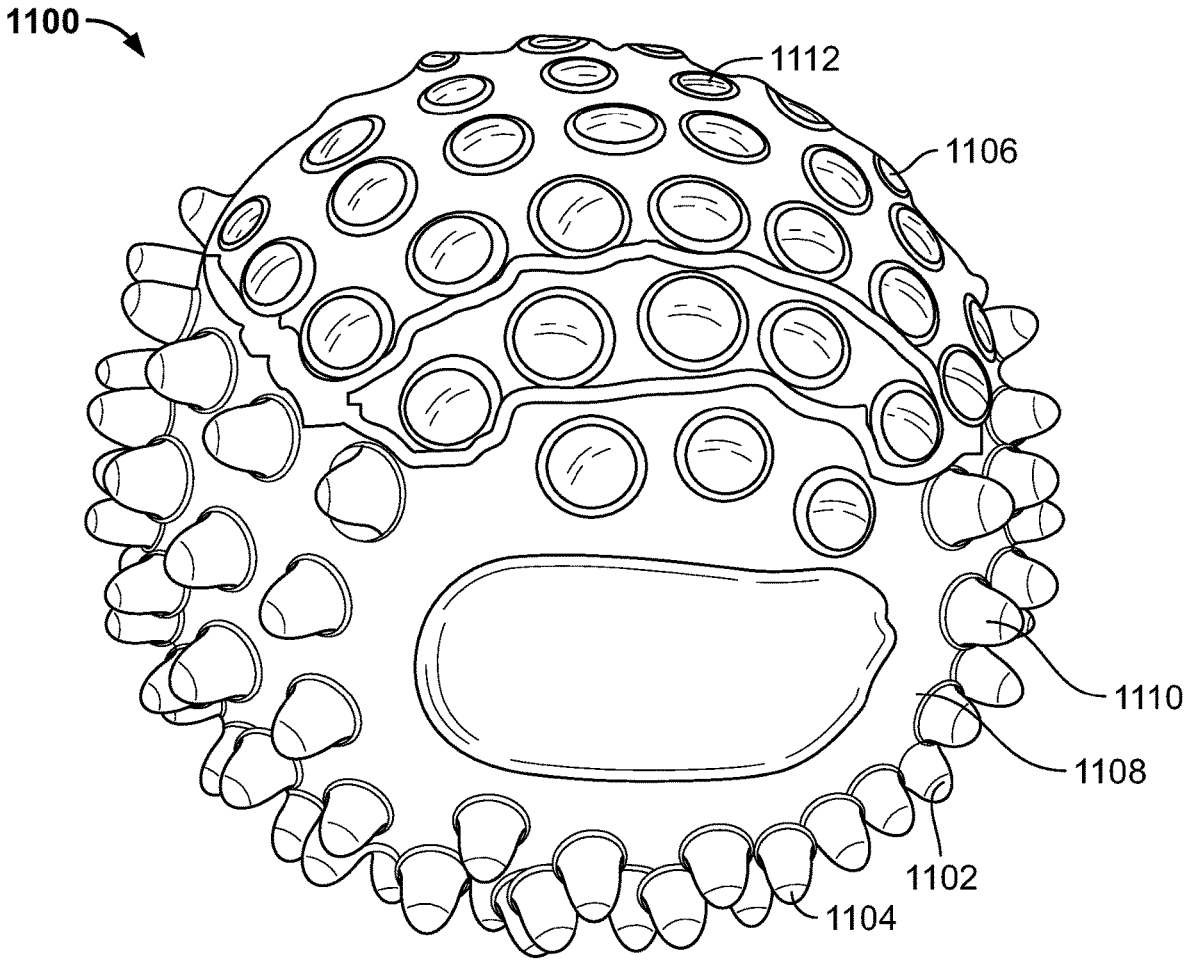
FIG. 15 illustrates an isometric view of a pliable object that can be used to implement the disclosed examples.

FIG. 15 illustrates an isometric view of a pliable object 1100 that may be used as the pliable object 106. In the example shown, the pliable object 1100 is an exercise ball 1102 having a first portion 1104 and a second portion 1106. The first portion 1104 has a surface 1108 having protrusions 1110 and a surface 1112 that does not have protrusions and, thus, is relatively smooth. As a result, when the pliable object 1100 is positioned in the pocket of one of the exercise and therapy devices, the first portion 1104 may face away from the pocket and the second portion 1106 may face the pocket. When the smooth surface 1112 of the second portion 1106 faces the ground, increased stability and balance may be provided to the individual standing on the pliable object 1100 or, more generally, using the exercise and therapy devices.

Figure 16:
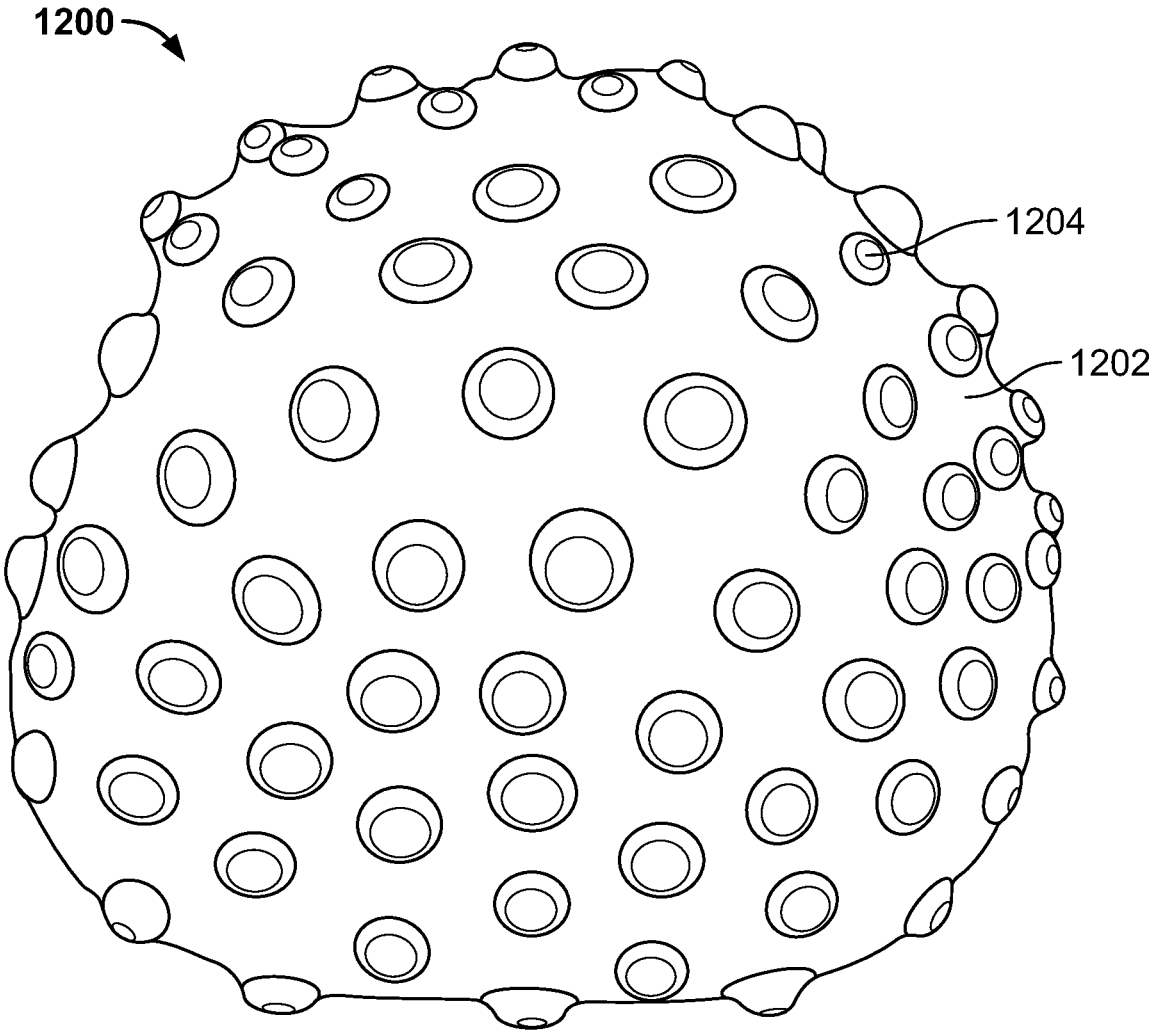
FIG. 16 illustrates an isometric view of another pliable object that can be used to implement the disclosed examples.

FIG. 16 illustrates an isometric view of a pliable object 1200 that may be used as the pliable object 106. In the example shown, the pliable object 1200 is an exercise ball 1202 having protrusions 1204. While the protrusions 1204 are shown, the exercise ball 1202 may have any other surface structure or may be relatively smooth.

The examples disclosed herein relate to methods and apparatus that address pliability including mobility in the ankle, dynamic stability, force transmission and distribution, myofascial release and/or hydration of connective tissue. Thus, the examples disclosed encourage individuals (e.g., athletes) to use their feet effectively by enabling exercises to be performed that work the superficial fascia to stimulate receptors in feet and/or encourage balance exercises where tension comes from the ground, via the feet, to create more stability across myofascia lines. The exercises performed using the disclosed examples may stimulate and/or hydrate connective tissue with different movement interplays and/or by alternating active lengthening exercises with counterposes (e.g., slow and then static) in which myofascial tissue may be softened. The connective tissue may include deep fascia. The exercises may include bouncing and/or rhythmical bouncing to progress a range of movement, pace and/or tissue tension. Other exercises may focus on encouraging elasticity of the body part (e.g., the foot) using dynamic and/or oscillating exercises, plasticity changes with melting stretches and/or stimulation-focused exercises using self-massage.

Additionally or alternatively, the disclosed examples can be used by individuals to stimulate loose fascia to promote glide between superficial and deep fascia layers. By securing an exercise prop (e.g., a massage or exercise ball) in place, the superficial layer of fascia can be "pinned" and slid over the underlying deep fascia layers. In other words, the rolling movements may be performed slowly by moving and/or rolling the skin over the underlying deep tissue layers. Moreover, exercises can be performed in which pressure and/or tension is sustained and/or applied and then released to soften or reduce the tension applied and/or to encourage stimulation and/or hydration. When an exercise ball is secured relative to the body part (e.g., the foot, the knee, the elbow), exercises can be performed in which pressure and/or tension is sustained and/or applied and then released to encourage the removal and/or release of inflammatory substances and/or waste products followed by tissue nourishment and/or removal and/or dissolve light adhesion of the collagen network to increase nutrient and/or oxygen supply to facia and other connective tissue of the body.

By using the examples disclosed herein, the foot is urged to be placed on the ground in a position that enhances structural balance. Using the exercise and therapy devices, an interaction between the foot and the ball applies relatively constant cushioning that increases the pliability of connective tissue and reduces and/or eliminates adhesions that may cause pain, lack of mobility and/or reduced structural balance. The straps may be secured to the foot, behind the knee or another part of the body to create pliability and/or to support hydration of the connective tissues behind the knee and/or within the elbow.

Exercise and/or physical therapy tools enable an athlete and/or participant to perform exercises in which the weight on and/or the position of the foot and/or the knee changes. Such exercises encourage a "sponge effect" that increases hydration of targeted tissues. Additionally, such exercises tend to add proprioceptors, increase stability and/or increase pliability including increased mobility in ankle joints. Some of the fitness tools include straps and/or bandages, for use with example fitness balls (e.g., myofascial balls) that enhance mobility and/or structural balance of a person using the example apparatus. In contrast to some known examples in which myofascial balls roll freely against target tissue, the fitness tools disclosed include straps or supports that are structured to retain the relative position of the ball against the target tissue enabling press and release type exercises to be performed. To enable the ball to be retained by the strap, in some examples, the strap defines a pocket structured to receive the ball. A fastener may be included to retain the ball in the pocket. The fastener may include adhesive, a cord extending through the ball and coupled to the strap, netting or mesh that covers the ball and is coupled to the strap, and/or any other suitable device for permanently or temporarily attaching the ball or prop to the strap.

Some exercises performed using the disclosed examples are associated with spine mobility exercises when the athlete stands in a relatively straight position while sustaining either plantar or dori flexion in the ankles. Other exercises performed using the disclosed examples encourage balance to be maintained, encourage gluteal muscles to be activated and/or encourage muscles in the pelvis to stabilize. When the example straps are used to secure a ball to the foot of an individual performing one or more of these exercises, the athlete is able to relax and perform the exercises without worrying that the ball will slip out from under their foot because the straps retain the relative position of the ball and the individual regardless of where the foot is located relative to the ground. To increase support and/or stability provided by the example strap, the strap may extend above the ankle.

By securing the fitness ball adjacent to the heel using a strap as disclosed, the individual can step on and off of the ball while performing different exercises while allowing the contact point between the ball and the foot to remain substantially the same. As a result of being able to perform different movements and retaining the relative position of the ball and the foot, the examples disclosed herein increase blood flow and/or foot biometrics as compared to the other known examples. Further, in contrast to some known examples in which the contact point between the ball and the foot changes when the individual applies and releases pressure on the ball, the examples disclosed herein enable the individuals to provide more attention to the movement of the exercises being performed because less attention is being paid to the location of the ball rolling around on the floor. Fitness balls used in connection with the straps may or may not include protrusions (e.g., spikes, nubs or rounded circles). When a bottom facing surface of the ball does not include protrusions, an amount of surface area that engages the ground increases which in turn increases stability for the person using the example apparatus.

While many exercises may be performed using the example straps and balls disclosed, an individual may perform squat exercises with the ankle strap coupling the ball adjacent to their heel. In some such examples, the heels come off the ground when performing the squat. By securing the ball relative to the ankle and by supporting the ankle using the example ankle strap, a relatively soft surface (e.g., the ball) is disposed beneath the heel of the individual all while encouraging increased pliability in the heel and/or foot to enable the individual to have enhanced flexibility in the lower leg. Securing the ball relative to the ankle also encourages better biomechanics for the entire body. With this enhanced flexibility and proper form, the individual may be able to perform squat exercises without lifting the heel off of the ground. Lifting the heel off the ground during such exercises may lead to injuries.

Further, while several examples have been disclosed herein, any features from any examples may be combined with or replaced by other features from other examples. Moreover, while several examples have been disclosed herein, changes may be made to the disclosed examples within departing from the scope of the claims.

The invention claimed is:

1. An exercise and therapy device, comprising:

a foot covering having an ankle support and a bottom portion comprising a semi-spherical pocket having an opening; and a pliable object received within the pocket and arranged to be placed adjacent a foot of an individual wearing the foot covering, the opening facing the foot to allow the pliable object to directly engage the foot when the pliable object is received within the pocket and the foot covering is worn by the individual.

2. The exercise and therapy device of claim 1, wherein the pocket is arranged to position the pliable object adjacent a heel of the foot.

3. The exercise and therapy device of claim 2, wherein the ankle support comprises a strap comprising the pocket, the strap further comprising a first portion and a second portion, the pocket positioned between the first and second portions, the first and second portions to be wrapped about a portion of an individual.

4. The exercise and therapy device of claim 3, further comprising a fastener carried by the first portion of the strap, the fastener arranged to attach the ankle support to the portion of the individual.

5. The exercise and therapy device of claim 1, further comprising rings, the rings coupled to the foot covering and arranged to position the rings on sides of a foot of an individual.

6. The exercise and therapy device of claim 1, wherein the foot covering comprises a strap, the strap comprising a first portion, the pocket, and a second portion, the first and second portions coupled to and extending from the pocket, the first and second portions to be wrapped about a bridge of the foot.

7. The exercise and therapy device of claim 1, wherein the pocket comprises a first pocket and the pliable object comprises a first pliable object, wherein the exercise and therapy device comprises a second pliable object and wherein the foot covering further comprises a second pocket, the second pocket arranged to receive the second pliable object to place the second pliable object adjacent the foot of the individual wearing the foot covering.

8. The exercise and therapy device of claim 7, wherein the first pocket is arranged to position the first pliable object adjacent a heel of the foot and the second pocket is arranged to position the second pliable object adjacent a ball of the foot.

9. The exercise and therapy device of claim 7, wherein the foot covering comprises an ankle support and a foot strap, the ankle support including the first pocket and the foot strap including the second pocket.

10. The exercise and therapy device of claim 9, wherein the ankle support is coupled to the foot strap via a central portion.

11. An exercise and therapy device, comprising:

a foot covering comprising an ankle support and a pocket; and a pliable object received within the pocket and arranged to be placed adjacent a foot of an individual wearing the foot covering, wherein the pliable object comprises protrusions that are spikes, nubs, or rounded circles, and wherein the protrusions directly engage the foot when the foot covering is worn by the individual.

12. An exercise and therapy device, comprising:

a foot covering comprising a pocket; and a pliable object comprising protrusions, the pliable object received within the pocket and arranged to be placed adjacent a foot of an individual wearing the foot covering, wherein the protrusions are arranged on a first portion of the pliable object, a second portion of the pliable object not including protrusions, the second portion to be arranged to face the pocket.

13. An exercise and therapy device, comprising:

a foot covering comprising an ankle support and a foot strap, the ankle support including a first pocket and the foot strap including a second pocket;

a first pliable object, the first pocket arranged to receive the first pliable object to place the first pliable object adjacent a foot of an individual wearing the foot covering;

a second pliable object, the second pocket arranged to receive the second pliable object to place the second pliable object adjacent the foot of the individual wearing the foot covering; and a first pair of rings coupled on either side of the ankle support and a second pair of rings coupled on either side of the foot strap.

* * * * *